US007524338B2

(12) United States Patent
Pedrazzini

(10) Patent No.: US 7,524,338 B2
(45) Date of Patent: Apr. 28, 2009

(54) ADDITIVE FOR REDUCING PARTICULATE IN EMISSIONS DERIVING FROM THE COMBUSTION OF DIESEL OIL OR FUEL OIL HAVING A METALLIC OXIDATION CATALYST, AT LEAST ONE ORGANIC NITRATE, AND A DISPERSING AGENT

(76) Inventor: Cesare Pedrazzini, 7, avenue, Saint Roman, MC-98000 Monte Carlo (MC)

( * ) Notice: Subject to any disclaimer, the term of this patent is extended or adjusted under 35 U.S.C. 154(b) by 455 days.

(21) Appl. No.: 10/343,532

(22) PCT Filed: Aug. 1, 2001

(86) PCT No.: PCT/EP01/08871

§ 371 (c)(1),
(2), (4) Date: May 22, 2003

(87) PCT Pub. No.: WO02/12417

PCT Pub. Date: Feb. 14, 2002

(65) Prior Publication Data

US 2004/0031192 A1 Feb. 19, 2004

(30) Foreign Application Priority Data

Aug. 3, 2000 (IT) ..... M12000A1815

(51) Int. Cl.

| | |
|---|---|
| ***C10L 1/14*** | (2006.01) |
| ***C10L 1/10*** | (2006.01) |
| ***C10L 1/22*** | (2006.01) |
| ***C10L 1/24*** | (2006.01) |
| ***C10L 1/30*** | (2006.01) |

(52) U.S. Cl. ..... 44/365; 44/358; 44/370; 44/385; 44/412; 44/435

(58) Field of Classification Search ..... 44/358, 44/365, 370, 385, 412, 435
See application file for complete search history.

(56) References Cited

U.S. PATENT DOCUMENTS

| | | | | | |
|---|---|---|---|---|---|
| 2,934,048 | A | * | 4/1960 | Young | 123/1 R |
| 3,231,592 | A | * | 1/1966 | McCord | 530/230 |
| 3,410,670 | A | * | 11/1968 | Le Suer | 44/401 |
| 3,539,312 | A | * | 11/1970 | Dadura et al. | 44/373 |
| 4,568,360 | A | * | 2/1986 | Brisset et al. | 44/364 |
| 5,118,282 | A | * | 6/1992 | Reynolds et al. | 431/4 |
| 5,804,537 | A | * | 9/1998 | Boffa et al. | 508/398 |
| 5,809,775 | A | * | 9/1998 | Tarabulski et al. | 60/274 |
| 6,003,303 | A | * | 12/1999 | Peter-Hoblyn et al. | 60/274 |
| 6,203,770 | B1 | * | 3/2001 | Peter-Hoblyn et al. | 423/212 |

FOREIGN PATENT DOCUMENTS

| | | |
|---|---|---|
| EP | 0078249 | 5/1983 |

(Continued)

*Primary Examiner*—Joseph D Anthony
(74) *Attorney, Agent, or Firm*—Simpson & Simpson, PLLC

(57) ABSTRACT

An additive composition for fuels such as diesel oil and fuel oil, used respectively for diesel engines and boilers of various types, containing a metal oxidation catalyst, in which the metal is iron, cerium, calcium, or their binary or ternary mixtures, an organic nitrate and a dispersing agent. The additive composition is able to reduce the formation of particulate emitted by diesel engines and boilers.

15 Claims, 4 Drawing Sheets

FOREIGN PATENT DOCUMENTS

| | | |
|---|---|---|
| EP | 0112219 | 6/1984 |
| EP | 0476196 | 9/1990 |
| EP | 0857777 | 8/1998 |
| GB | 2091291 | 7/1982 |
| GB | 2248068 | 3/1992 |
| WO | WO 96/21708 | 7/1996 |
| WO | WO 97/04045 | 2/1997 |
| WO | WO 97/44414 | 11/1997 |
| WO | WO 98/04655 | 2/1998 |

* cited by examiner

ADDITIVE FOR REDUCING PARTICULATE IN EMISSIONS DERIVING FROM THE COMBUSTION OF DIESEL OIL OR FUEL OIL HAVING A METALLIC OXIDATION CATALYST, AT LEAST ONE ORGANIC NITRATE, AND A DISPERSING AGENT

CROSS REFERENCE TO RELATED APPLICATIONS

This application is a National Stage application of International Application No. PCT/EP01/08871, filed Aug. 1, 2001, which is incorporated by reference herein and claims priority from Italian patent application MI2000A1815, filed Aug. 3, 2000 which is incorporated by reference herein.

FIELD OF THE INVENTION

The present invention relates to an additive for fuels such as diesel oil and fuel oil, used respectively for diesel engines and boilers for civil and industrial uses, useful for reducing particulate in emissions.

PRIOR ART

Diesel oil and fuel oils are fuels widely used in various sectors, from motor vehicles to civil or industrial heating.

For the sake of simplicity, we shall refer below only to the use of diesel fuel in internal combustion engines (diesel cycle engines), while it remains understood that what follows applies equally to any use of diesel oil and of fuel oils, in which the combustion process produces emissions.

In recent years the technical evolution of alternative internal combustion engines has been closely connected with the impelling need to ensure a more and more rational use of natural energy sources, at the same time limiting the effects of environmental pollution derived from their use. This has led to the introduction of substantial technical modifications to the engine, involving in different ways engines with ignition by command, that is petrol engines, and those with ignition by compression, that is diesel engines. Therefore the respective technical innovations, though springing from the same needs, have followed profoundly different paths.

The different ways of tackling these problems originate from the different trend of the combustion process in petrol engines with respect to diesel engines. In diesel engines, contrary to what occurs in petrol engines, the charge formation process takes place in the form of tiny drops of fuel which burn in conditions of high excess of air as an effect of the high temperature reached by the air during the compression phase.

Despite the tiny size of the drops, which have a diameter of one hundredth of a millimetre, obtained thanks to very high injection pressures (up to 1500 atmospheres), the process with which they are distributed inside the combustion chamber is far from being uniform. Consequently there are areas in the combustion chamber in which, even in the presence of considerable excesses of air, the diesel fuel oxidation process takes place only in part.

The nuclei of the fuel particles that have not yet been reached by the oxidation process, since they are at the same time in conditions of high temperature and lack of oxygen, encounter complex phenomena of thermal cracking (pyrolysis) which substantially alter their original physical-chemical structure.

This phenomenon is generally considered the primary cause of the formation of those characteristic particles of material, of a carbon nature, emitted by the exhaust of diesel engines, technically defined "particulate", though it is more commonly known as soot or lampblack. Particularly dangerous is the "particulate"fraction PM 10 consisting of particles with a mean diameter of less than 10 μm containing about 75% benzopyrene, acenaphthene, anthracene, phenanthrene, and similar polycyclic aromatic hydrocarbons of a higher class, having proven carcinogenic activity.

Despite the high values of the dosing ratio and the considerable efforts made to improve the efficiency of the combustion process, the carbon particulate responsible for the grade of smoke is always present to a more or less accentuated extent in the exhaust of diesel engines and, as well as certain proof of bad energetic exploitation of the fuel, it is a cause of considerable decline in the environment and serious damage to health.

Since the carbon particulate constitutes one of the principal harmful emissions of diesel engines, the greatest efforts made by vehicle manufacturers in recent years have concentrated essentially on reducing this pollutant.

The steps taken may be essentially summed up in the following actions: a) actions taken directly in the combustion process in the engine in order to prevent the formation of polluting substances; b) application of devices for treating burnt gases in order to convert the harmful substances into harmless products; c) modification of the fuel composition. The actions in category a) include all the steps taken to improve the efficiency of the combustion process, since the formation of the particulate PM 10 is due above all to the incompleteness of that process.

The actions in category b), on the other hand, include the devices for treating burnt gases applied on the exhaust of diesel engines, known as "particulate traps", which filter and eliminate the carbon particles formed in the engine during the combustion process.

Generally the traps for particulate PM 10 are composed of a ceramic support of a porous type which presents a plurality of parallel channels, alternately closed and open at the ends, on the walls of which the particulate is deposited by filtration. To prevent the material that has accumulated in the support from creating an excessive back pressure at the engine exhaust, with consequent loss of power and greater fuel consumption, the operation of the traps always includes a particulate elimination cycle (or "cleaning" phase), known also as a "regeneration process", during which, by means of suitable technical improvements, the particulate is burnt and converted into carbon dioxide and water.

The system (c) refers only to the use as fuel of an emulsion of water and liquid fuel, containing generally 10-30% water and 90-70% fuel.

The solutions supplied up till today for eliminating particulate from exhaust gas, as briefly indicated above, have not offered and do not offer a satisfactory solution to the serious problem since, in processes of type (a), the physical-chemical characteristics of the fuel in the heterogeneous phase constitute an unsurpassable limit to the increase of reactivity and therefore to the efficiency of the engine. As regards the devices of type (b), up till now their realisation has been too expensive from the economic point of view to make it possible to consider their use on a wide scale. Finally the use of emulsions of water and fuel (point (c)), as well as giving an unsatisfactory reduction of particulate, considerably increases the risk of corrosion of the engine or of the burners, due both to the water and to the acids which the water can form with the sulphur in the fuel.

Besides, an effective solution for the reduction of these pollutants is made even more urgent by the new European antismog standards, which regulate the maximum emissions of pollutants from petrol and diesel engines in accordance with two standards that will come into force with different time scales, the Euro 3 from 1 Jan. 2001 and the Euro 4 from 1 Jan. 2006, surpassing the current standard Euro 2, in force since 1 Jan. 1997.

In the table below, expressed in g/Km, are the maximum emissions of particulate PM10, nitrogen oxide $NO_x$, carbon monoxide CO and unburnt hydrocarbons HC, allowed by the above standards for diesel motor vehicles.

| | PM10 | $NO_x$ | CO | HC + $NO_x$ |
|---|---|---|---|---|
| Euro 2 | 0.100 | n.r.* | 1 | 0.70 |
| Euro 3 | 0.050 | 0.50 | 0.64 | 0.56 |
| Euro 4 | 0.025 | 0.25 | 0.50 | 0.30 |

n.r. = not recorded

*n. r.=not recorded

As may be seen, the standard is becoming stricter so there is a strongly felt need to find a solution to limit the emissions of pollutants from the exhausts of diesel engines so as to comply with the new European standards.

SUMMARY OF THE INVENTION

The Applicant has now found that the use of an additive for diesel (fuel oil) engines composed of a mixture comprising a metallic oxidation catalyst, an organic nitrate and a dispersing agent in suitable ratios, improves combustion efficiency in such a way as to reduce the formation of particulate by as much as 90%.

This additive has been particularly effective in reducing the emission of particulate, but it has also proved to be useful in favouring every single phase of the combustion process, thus obtaining a better degree of cleanliness in the so-called low temperature areas, and better heat exchange conditions thanks to the drastic decrease of dirt due to the reduction of residue and of unburnt carbons in the cylinders and in the exhaust manifolds.

Moreover it was unexpectedly found that, besides reducing particulate by as much as 90%, the additive also affects the emissions of controlled pollutants, reducing them altogether by as much as 80%.

In this invention the term "controlled pollutants" means carbon monoxide (CO), unburnt hydrocarbons (HC and nitrogen oxides ($NO_x$).

The present invention therefore relates to an additive for diesel oil and fuel oil, characterised in that it comprises:

A) a metallic oxidation catalyst, in which the metal is chosen from the group comprising iron, cerium, calcium, and their binary or ternary mixtures, B) at least one organic nitrate, C) a dispersing agent.

As catalyst (A) ternary mixtures are preferred.

The fuel composition containing this additive constitutes a further object of the invention.

The characteristics and the advantages of the present additive for reducing the particulate emitted by diesel engines, as well as offering the advantages already mentioned above, will be illustrated in detail in the following description.

DETAILED DESCRIPTION OF THE INVENTION

Figure 1:
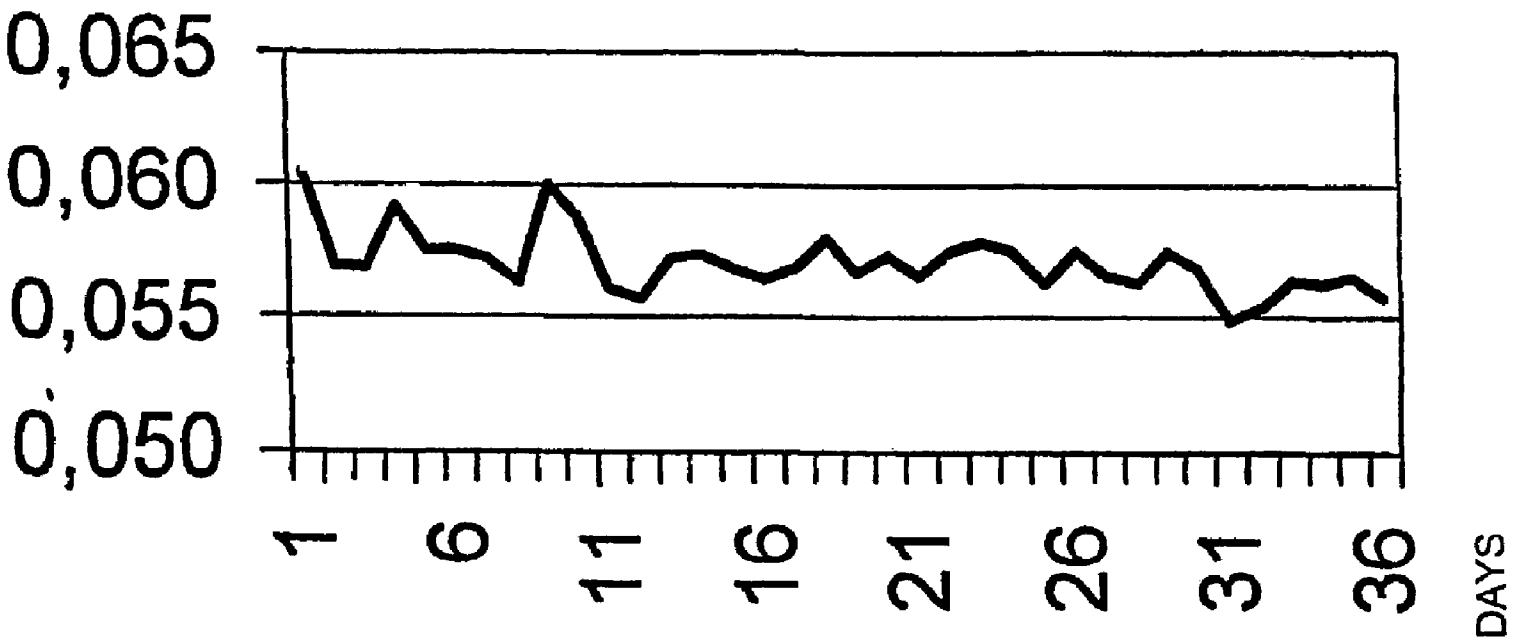
FIGS. 1 and 2 show respectively the trend of the specific consumption of fuel oil per ton of steam produced and the vaporization index over time, that is the tons of steam produced per ton of fuel.

In the metallic oxidation catalyst A) according to the invention the metal is chosen from iron, cerium, calcium, and their binary or ternary mixtures, and it salifies acids chosen preferably in the classes represented by the following formulae:

(I) R—COOH in which R is an aliphatic radical $C_7$-$C_{17}$, linear or branched, saturated or unsaturated, or is an alicyclic radical $C_5$-$C_{12}$ (II)

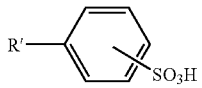

in which R' is H or a $C_1$-$C_{12}$ aliphatic radical and the sulphonic groups can be one or more and can be in whatever position.

These carboxylic and benzenesulphonic acids may be present in a mixture even in natural products.

The quantity of the components in the metallic oxidation catalyst A), expressed as a percentage of the weight with respect to the total weight of the catalyst, is 0-8% of Ce, 0-8% of Fe, 0-5% of Ca, it being understood that at least one of these metals must be present. Preferred quantities are 6% of Ce, 6% of Fe, 3% of Ca, taken individually or in a mixture.

The additive according to the present invention generally contains a quantity of metallic oxidation catalyst A) between 2 and 30% of the weight with respect to the total weight of the catalyst, and preferably amounting to 15% of the weight.

The organic nitrate B) in the invention is typically chosen from the group composed of amyl nitrate, i-amyl nitrate, and i-octyl nitrate (that is nitrate of 2-ethyl-hexyl alcohol) and their binary or ternary mixtures in a percentage of between 50 and 70% of the weight with respect to the total weight of the additive, and preferably amounting to 65% of the weight.

The dispersing agent C) is generally chosen from alkylamines, alkylamides, alkylaryl amines and alkylaryl amides, and it is present in the additive according to the invention in quantities between 5 and 15% of the weight, preferably amounting to 10%.

Preferred dispersing agents C) according to the invention are alkylamides and alkylamines with aliphatic chain $C_{10}$-$C_{24}$.

The dispersing agent (C) generally causes an increase in the activity of (A)+(B). A particularly high synergetic effect has been obtained by adding to the mixture of organic nitrates and metallic catalysts as described above, a dispersing product with a base of polyolefin amines or of alkylaryl amines and an olefin-alykylester copolymer. Products suitable for realising the present invention are, for example, those available on the market under the name Wax AntiSettling Agents (WASA). Besides the essential components indicated above, the additive according to the present invention may contain, and generally does contain, small quantities of agents suited for improving specific aspects of the mixture such as its stability on oxidation, inhibition of corrosion, slipperiness, the foaming property of the fuel (antifoam) and cold workability (CFPP—Filter Plugging Point).

Any fuel for diesel engines may be used to realise the present invention.

The additive according to the invention may be added to the fuel in a quantity comprised between 1 and 10 g/l of fuel; an additive quantity comprised between 1 and 5 g/l of fuel, and preferably of 3.5 g/l, allows to obtain an efficent reduction of the particulate.

The fuel composition of the invention may also contain further additives conventionally used as a fuel for diesel engines, in the quantities in which they are generally used. For example, it may contain conventional agents such as agents that further improve slipperiness and stability, corrosion inhibitors and similar agents.

The additive according to the invention, mixed with fuel for diesel engines, drastically reduces the particulate in the emissions of diesel engines for motor vehicles, locomotives, ships, earth moving machinery, but also for diesel engines used in pumping stations or installations for the generation of electric power. The additive according to the invention may be used with the same advantages listed above also for reducing the particulate emitted by heating systems fed with fuel oil, since the fuel oil combustion systems in boilers fed with this fuel are similar to those that govern the oxidation process in an internal combustion engine, though with a distinctly lower air/fuel ratio.

Exhaust Gases Control Technique-Control on the Field

In the countries that contemplate an obligatory control on the field, besides the values of the controlled pollutants, the checking of the diesel vehicle also concerns the opacity of the diesel smoke. The emission of smoke is determined with free acceleration, that is with acceleration up to full running speed, maximum rotation speed, starting from minimum rotation speed, with the gear disengaged; the acceleration therefore acts against the mass of the engine. The measurement of opacity is carried out with a special instrument, the opacimeter, in which the exhaust gas taken by a probe is conveyed into the measuring chamber; the luminous path inside the chamber varies according to the colour and density of the gas; the degree of absorption is a function of the opacity.

The weakening of the light is represented on a display as the absorption coefficient or K coefficient ($m^{-1}$), or as the concentration of mass per unit volume ($mg/m^3$).

The absorption coefficient is a magnitude for determining the amount of light that is absorbed by the soot (particulate), by white smoke and by blue smoke with relation to a light path of 1 m. This is irrespective of the measuring instrument used. The mass concentration indicates the amount of particulate expressed in mg which is emitted by the diesel vehicle with relation to 1 $m^3$ of exhaust gas. The absorption coefficient is converted into concentration in the mass by means of conversion tables drawn up by various organisation, one of the most used of which is that of the MIRA Motor Industry Research Association.

For the determinations carried out on cars and trucks in the examples given below, equipment by ROBERT BOSCH GmbH (Stuttgart) was used, and in particular:

1) Bosch Tester for analysing diesel fumes (opacity method) model RTT100.

2) Bosch Tester Version RTM430 RTMV2.0.

As additive for the fuel oil used in the tests in the following examples, a mixture thus composed was used:

a) metallic oxidation catalyst composed of 5% Ce, 7% Fe, 2.5% Ca, in the form of salts of aliphatic acids $C_8$ for Ce, $C_{18}$ for Fe, and dodecyl benzenesulphonic acid for Ca. The catalyst is present in the additive in a quantity of 10% of weight with respect to the total weight of the additive;

b) i-octyl nitrate in a quantity of 70% of weight with respect to the total weight of the additive;

c) as dispersing agent Para-Flow 412 (Exxon) was used (50% of active substance) In a quantity of 20% of weight with respect to the total weight of the additive.

The above additive was added to the diesel fuel a quantity of 3.5 g/l of diesel fuel. in order to eliminate the deposits formed in the engine, in the exhaust manifolds and in the exhaust pipe during previous use of the engine with non-additived fuel, it was found that it was necessary to run for 1 h for every previous 1000 km. Only after this time does the additive give maximum yield on the emissions.

The following examples are provided as illustration, without limitation on the present invention.

EXAMPLE 1

Opacity Test with Appliance Bosch RTM430

The test was carried out on a CHRYSLER VOYAGER 2.5 TDSE, 4 cylinders, displacement 2499 $cm^3$; kW 85 equivalent of 115 HP, maximum power 4000 rpm; km travelled by the vehicle before the test: 102,000 Km.

| | Standard diesel | Standard diesel + additive |
|---|---|---|
| K coefficient ($m^{-1}$) | 7.48* | 1.19 |
| mass concentration ($mg/m^3$) | 980 | 193 |

*n.b. value at the limit of the scale, obtained by extrapolating the concentration value in $mg/m^3$

EXAMPLE 2

Opacity Test with Appliance Bosch RTM 430

The test was carried out on a NISSAN ALMERA DI LUXURY 5 door., 4 cylinders, displacement 2184 $cm^3$; 81 kW equivalent of 110 HP, maximum power 4000 rpm; km travelled by the vehicle before the test: 3,000 Km.

| | Standard diesel | Standard diesel + additive |
|---|---|---|
| K coefficient ($m^{-1}$) | 1.63 | 0.26 |
| mass concentration ($mg/m^3$) | 268 | 35 |

EXAMPLE 3

Opacity Test with Appliance Bosch RTM 430

The test was carried out on an OPEL FRONTERA DTI 16 V 2.2. Sport R.S; 4 cylinders, displacement 2171 $cm^3$; 85 kW equivalent of 115 HP, maximum power 3800 rpm; km travelled by the vehicle before the test: 16,000 Km.

| | Standard diesel | Standard diesel + additive |
|---|---|---|
| K coefficient ($m^{-1}$) | 2.29 | 0.35 |
| mass concentration ($mg/m^3$) | 379 | 53 |

EXAMPLE 4

Opacity Test with Appliance Bosch RTM 430

The test was carried out on a FIAT MAREA JTD 105 SX; 4 cylinders, displacement 1910 $cm^3$; 77 kW equivalent of 105 HP, maximum power 4000 rpm; km travelled by the vehicle before the test: 11,000 Km.

| | Standard diesel | Standard diesel + additive |
|---|---|---|
| K coefficient ($m^{-1}$) | 1.94 | 0.26 |
| mass concentration ($mg/m^3$) | 320 | 35 |

EXAMPLE 5

Opacity Test with Appliance Bosch RTM 430

The test was carried out on a VOLKSWAGEN POLO 1.9 SDI 3 doors; 4 cylinders, displacement 1896; 47 kW equivalent of 64 HP; maximum power 4200 rpm; km travelled by the vehicle before the test: 66,000 Km.

| | Standard diesel | Standard diesel + additive |
|---|---|---|
| K coefficient ($m^{-1}$) | 3.27 | 0.38 |
| mass concentration ($mg/m^3$) | 536 | 57 |

EXAMPLE 6

Opacity Test with Appliance Bosch RTM 430

The test was carried out on a VOLKSWAGEN GOLF TDI HIGHLINE 3P; 4 cylinders, displacement 1896; 85 kW equivalent of 115 HP, maximum power 4000 rpm; km travelled by the vehicle before the test: 9,500 Km.

| | Standard diesel | Standard diesel + additive |
|---|---|---|
| K coefficient ($m^{-1}$) | 1.78 | 0.27 |
| mass concentration ($mg/m^3$) | 294 | 38 |

EXAMPLE 7

Opacity Test with Appliance Bosch RTM 430

The test was carried out on a MERCEDES C200 CDI CLASSIC, 4 cylinders; displacement 2151; 75 kW equivalent of 102 HP, maximum power 4200 rpm; km travelled by the vehicle before the test: 70,500 Km.

| | Standard diesel | Standard diesel + additive |
|---|---|---|
| K coefficient ($m^{-1}$) | 2.02 | 0.20 |
| mass concentration ($mg/m^3$) | 335 | 33 |

EXAMPLE 8

Opacity Test with Appliance Bosch RTT 100

The test was carried out on a truck SCANIA DS 1410; 8 cylinders; displacement 14200 $cm^3$; 333 kW equivalent of 453 HP, maximum power 1900 rpm; km travelled by the truck before the test: 224,000 Km.

| | Standard diesel | Standard diesel + additive |
|---|---|---|
| K coefficient ($m^{-1}$) | 3.22 | 0.86 |
| mass concentration ($mg/m^3$) | 529 | 133 |

EXAMPLE 9

A Breda boiler 500 ton/h (steam production) was fed with fuel oil having the following characteristic parameters:

| | |
|---|---|
| V | 100 ppm |
| Ni | 50 ppm |
| Na | 25 ppm |
| Ash | 360 ppm |
| S | 2.7% |
| Asphaltenes | 7.8% |
| Conradson | 14.4% |
| N | 0.44% |
| Viscosity at 75° C. | 110 cst |
| Working conditions: | |
| Steady running state | 92% |
| Air excess | 1.5 ÷ 3.5% (as $O_2$) |
| Fuel oil pulverisation (f.o.) | 110 cst |
| Air temperature | 25° C. |

To this fuel oil were added 3.5 g/l of the additive according to the present invention, composed of:

a) ternary oxidation catalyst comprising Ce 6%, Fe 6%, Ca 3%: Cerium as sulphonate, Iron as thallate, Calcium as sulphonate. Altogether the catalytic mixture accounts for 15% of the weight with respect to the total weight of the additive;

b) organic nitrate composed of i-octyl nitrate in a quantity of 65% of the weight with respect to the total weight of the additive;

c) dispersing agent composed of ADX 3856 W (ADIBIS) (with 50% active part) in a quantity of 20% of the weight with respect to the total weight of the additive.

Figure 2:
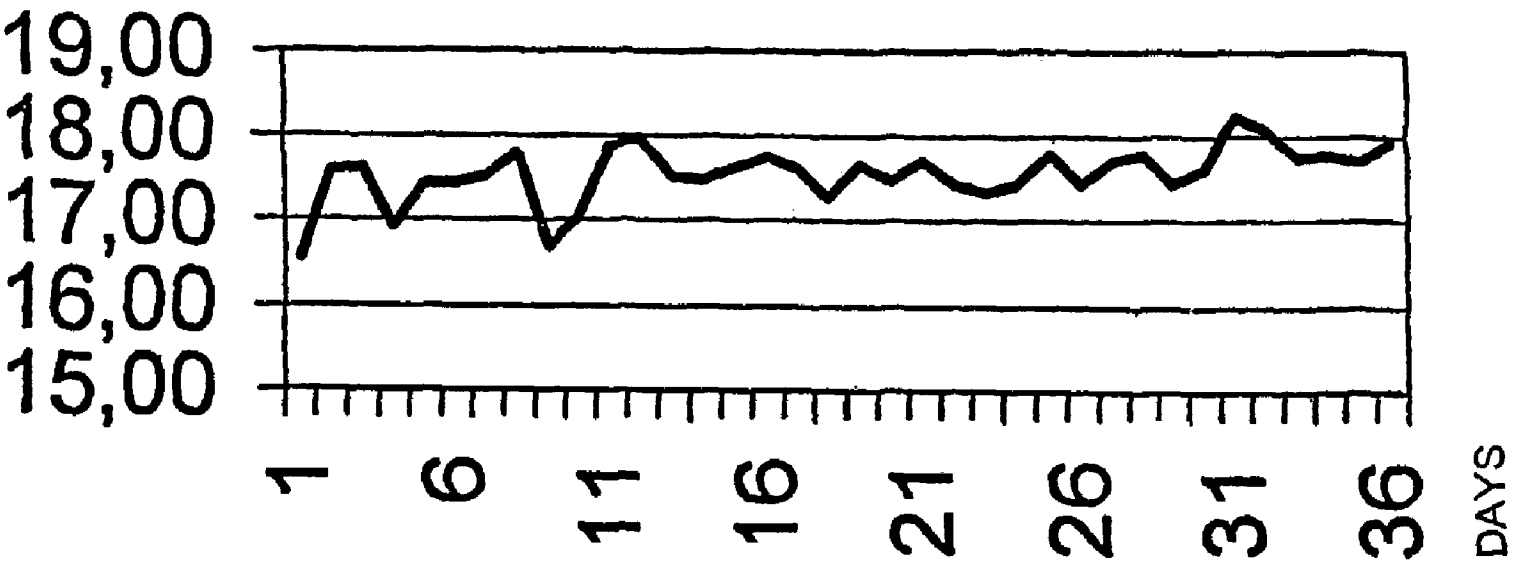

The improvement of the combustion process of the boiler thanks to the use of the additive according to the present invention may be seen from FIGS. 1 and 2, where is shown respectively the trend of the specific consumption of fuel oil per ton of steam produced and the vaporization index over time, that is the tons of steam produced per ton of fuel. From the two figures it may be clearly seen how the vaporization index tends to increase and the oil consumption tends to decrease already in the first 30-40 days of operation.

Figure 3:
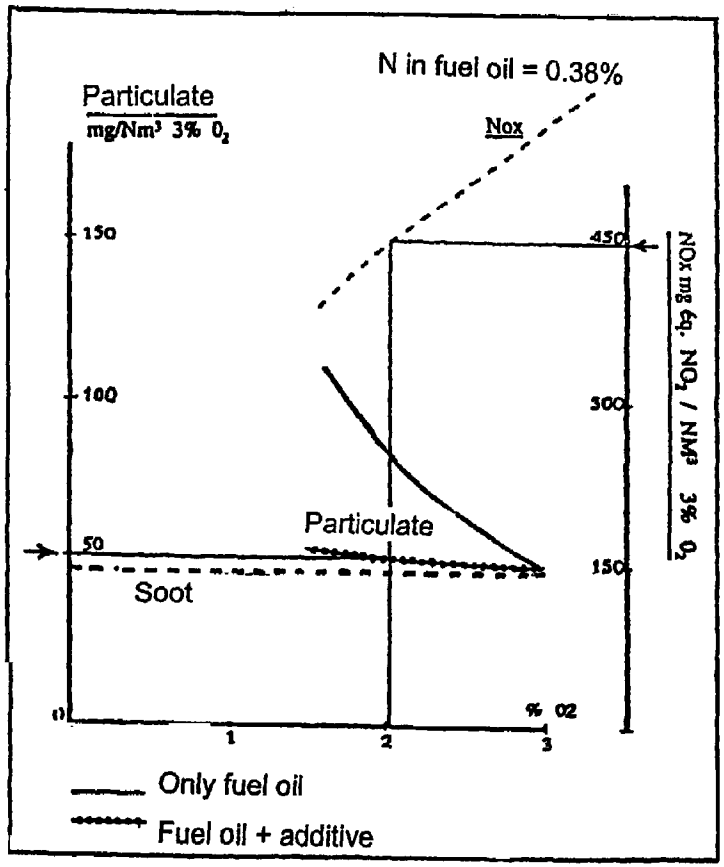
FIG. 3 shows the variations of the emissions when the additive of the invention is present in the fuel, in comparison with non additived fuel.

The diagram in FIG. 3 shows the variations of the emissions when the additive of the invention is present in the fuel, in comparison with non additived fuel. From this diagram it may seen that the use of the present additive lowers the presence of particulate by 62% in comparison with non additived fuel even with a low excess of $O_2$, thus also favouring the reduction of $NO_x$.

In particular, in the diagram, a reduction of particulate emission is shown, which is reduced up to values inferior to 50 mg/Nmc; the reduction in $NO_x$ emission is reduced up to 450 mg/Nmc and the average value of soot is 45 mg/Nmc.

Figure 4:
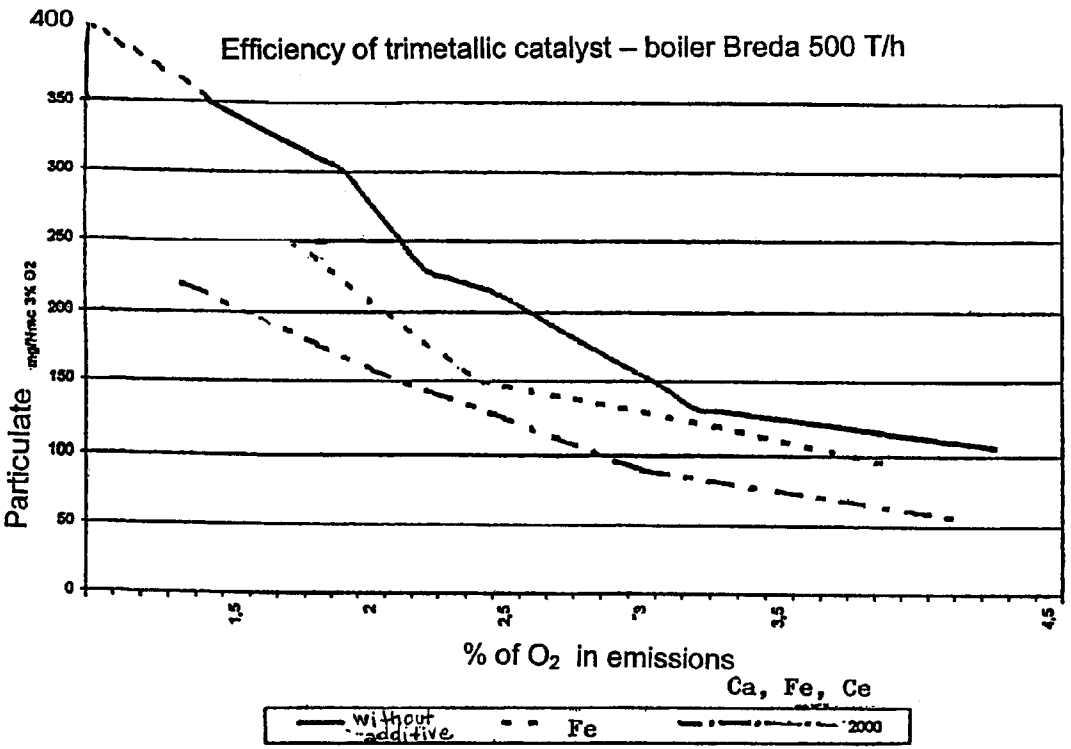
FIG. 4 shows the efficiency of the trimetallic oxidation catalyst Ce—Fe—Ca included in this additive.

In FIG. 4, showing the trend of the quantity of particulate in the boiler emissions as a function of the excess of $O_2$ in the air injected with the fuel, the efficiency of the trimetallic oxidation catalyst Ce—Fe—Ca included in this additive may particularly be seen.

EXAMPLE 10

Opacity test with appliance Bosch RTM 430

The test was conducted on a Volvo V 70 2.5 D; 5 cylinders, displacement 2460 $cm^3$, maximum power 103 Kw;

km travelled by the vehicle before the test: 61.000.

An additive having the following composition was prepared:

A) ternary catalyst consisting of: Ce 5%, in the form of aliphatic acids salts, Fe 7% in the form of $C_{18}$ aliphatic acids, Ca 2.5%, in the form of dodecylbenzensulphonic acids.

Accounts for 20% of the additive

B) i-octyl-nitrate

Accounts for 60% of the additive.

C) Dispersing agent W.A.S.A. (wax Antisetting Agents).

Accounts for 20% of the additive.

The so prepared additive was used in 5 road tests, increasing the quantity of additve used in respect of the standard Diesel (S.D.) as indicated hereinafter:

| | |
|---|---|
| 3 g/l | (test 10.1) |
| 3.5 g/l | (test 10.2) |
| 4.0 g/l | (test 10.3) |
| 5.0 g/l | (test 10.4) |
| 10.0 g/l | (test 10.5). |

| | S. D | S.D + 10.1 | S.D. + 10.2 | S.D. + 10.3 | S.D. + 10.4 | S.D. + 10.5 |
|---|---|---|---|---|---|---|
| Coefficient K ($m^{-1}$) | 2.96 | 0.9 | 0.58 | 0.44 | 0.44 | 0.44 |
| mass concentration ($mg/m^3$) | 490 | 145 | 91 | 71 | 71 | 71 |
| Δ Particulate | 0 | −70 | −81 | −85 | −85 | −85 |

Some comparative test was also performed in order to show how critical is the presence of the three components (a), (b), (c) for obtaining a synergy effect which allows results which could not be achieved with the single components and could not be foreseen in the light of such results.

EXAMPLE 11

Using a car AUDI A4 2.5 TDI V6, 6 cylinders, displacement 2496 $cm^3$, maximum power 110 Kw, km travelled before the test 25500 and the Bosch opacimeter RTM 430, some tests on standard diesel (S.D.) alone or added with additives having various compositions were performed.

Test 11.1—S.D. +0.6 g/l Fe thallate with 2% Fe;

Test 11.2—S.D. +0.5 g/l catalyst TRI consisting of Ce 5% (in the form of octoate), Fe 7% (in the form of thallate), Ca 3% (in the form of dodecylbenzensulphonate);

Test 11.3—S.D. +3.5 g/l of additive consisting of i.ottyl nitrate 60%, W.A.S.A. 20%, Fe—thallate 20%.

Test 11.4—S.D. +3.5 g/l additive consisting of i.ottyl nitrate 60%, W.A.S.A. 20%, catalyst TRI 20%.

| | S.D | S.D + 11.1 | S.D. + 11.2 | S.D. + 11.3 | S.D. + 11.4 |
|---|---|---|---|---|---|
| Coefficient K ($m^{-1}$) | 1 | 0.7 | 0.64 | 0.28 | 0.25 |
| Mass concentration ($mg/m^3$) | 162 | 114 | 106 | 38 | 33 |
| Δ Particulate | 0 | −30 | −36 | −77 | −80 |

Analogous tests have been performed using also Calcium dodecylbenzensulphonate and Cerium octoate, measuring analogous results.

EXAMPLE 12

Comparative

An additive consisting of:

| | | |
|---|---|---|
| (b) | i. octyl nitrate | 75% |
| (c) | W.A.S.A. | 25% |

was prepared.

The above said additive was used in two tests, in different quantities:

2.0 g/l diesel-test (12.1)

3.0 g/l diesel—test (12.2)

The tests were performed on a FIAT MAREA JTD 105 SX; 4 cylinders, displacement 1910 $cm^3$; maximum power Kw 77; km travelled by the vehicle before the test: 14000.

Bosch Opacimeter RTM 430

| | S.D | S.D + 12.1 | S.D. + 12.2 |
|---|---|---|---|
| Coefficient K ($m^{-1}$) | 1.86 | 1.27 | 1.23 |
| mass concentration ($mg/m^3$) | 308 | 208 | 203 |
| Δ Particulate | 0 | −32 | −34 |

EXAMPLE 13

Comparative

With the same additive described in Example 12, two tests have been performed, using 2.0 g/l (test 13.1) and 3.0 g/l (test 13.2) respectively, on a different car: 10. AUDI A4 2.5 TDI V6, 6 cylinders, displacement 2496 $cm^3$; maximum power 110 Kw; km travelled before the test 25500.

Bosch opacimeter RTM 430

| | S.D | S.D + 13.1 | S.D. + 13.2 |
|---|---|---|---|
| Coefficient K ($m^{-1}$) | 1.57 | 1.0 | 0.97 |
| mass concentration ($mg/m^3$) | 256 | 162 | 1.56 |
| Δ Particulate | 0 | −36 | −38 |

Comparing the examples 12 and 13 with example 10 it is immediately evident that, in the absence of the metal catalyst the maximum decrease of particulate is 38% compared to a reduction up to 85% achieved with the ternary system according to the invention as shown in the above reported examples.

The invention claimed is:

1. An additive for diesel oil and fuel oil, consisting essentially of: A) a metallic oxidation catalyst consisting of a ternary mixture of iron, cerium, and calcium each in the form of at least one salt, B) at least one organic nitrate, and C) a dispersing agent wherein said additive reduces emissions of particulates, CO, and NOx, wherein the quantity of the oxidation catalyst A) is between 2 and 30% in weight of active substance with respect to the total weight of the additive, the quantity of organic nitrate B) is between 50 and 70% in weight of active substance with respect to the total weight of the additive, and the quantity of the dispersing agent C) is between 5 and 15% in weight of active substance, with respect to the total weight of the additive.

2. The additive according to claim 1, in which said ternary mixture is present in the oxidation catalyst A) in the form of salts with acids chosen from the group consisting of:

(I) R-COOH in which R is chosen from the group consisting of an aliphatic radical $C_7$-$C_{17}$, and an alicyclic radical $C_5$-$C_{12}$;

and,

II a compound of the formula:

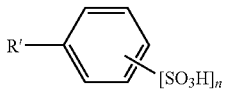

(II)

in which R' is H or an aliphatic radical $C_1$-$C_{12}$ and n is 1 to 5.

3. The additive according to claim 2, wherein the oxidation catalyst consists of a ternary mixture Fe—Ce—Ca in the form of salts of aliphatic acids $C_8$ for Ce, $C_{18}$ for Fe, and dodecyl benzenesulphonic acid for Ca.

4. The additive according to claim 1 wherein the oxidation catalyst consists of a ternary mixture Fe—Ce—Ca in the form of salts of aliphatic acids $C_8$ for Ce, $C_{18}$ for Fe, and dodecyl benzenesulphonic acid for Ca.

5. The additive according to claim 1, wherein said oxidation catalyst A) consists of a ternary mixture containing 5% Ce, 7% Fe, and 2.5% Ca with respect to the total weight of the catalyst.

6. The additive according to claim 1, wherein said oxidation catalyst A) consists of a ternary mixture containing 6% Ce, 6% Fe, and 3% Ca with respect to the total weight of the catalyst.

7. The additive according to claim 1, wherein the organic nitrate B) is chosen from the group consisting of amyl nitrate, i-amyl nitrate, i-octyl nitrate and their binary or ternary mixtures.

8. The additive according to claim 7, wherein the organic nitrate B) is i-octyl nitrate.

9. The additive according to claim 1, wherein the dispersing agent C) is chosen from the group consisting of alkylamines, alkylamides, alkylaryl amines and alkylaryl amides.

10. The additive according to claim 9, wherein the dispersing agent C) is chosen from the group consisting of alkylamines and alkylamides with aliphatic chains $C_{10}$-$C_{24}$.

11. The additive according to claim 1, wherein the quantity of the oxidation catalyst A) is 15% in weight of active substance with respect to the total weight of the additive, the quantity of organic nitrate B) is 65% in weight of active substance with respect to the total weight of the additive and the quantity of the dispersing agent C) is 10% in weight of active substance, with respect to the total weight of the additive.

12. The additive according to claim 1, wherein the quantity of the oxidation catalyst A) is 10% in weight of active substance with respect to the total weight of the additive, the quantity of organic nitrate B) is 60% in weight of active substance with respect to the total weight of the additive and the quantity of the dispersing agent C) is 15% in weight of active substance, with respect to the total weight of the additive.

13. A method for increasing the combustion efficiency of diesel oil and fuel oil in order to drastically reduce the particulate emission comprising: adding an additive to a fuel selected from the group consisting of diesel oil and fuel oil, wherein the quantity of additive is between 1 and 10 g/l of fuel and wherein said additive consists essentially of A) a metallic oxidation catalyst consisting of a ternary mixture of iron, cerium, and calcium, each in the form of at least one salt, B) at least one organic nitrate, and C) a dispersing agent, wherein the quantity of the oxidation catalyst A) is between 2 and 30% in weight of active substance with respect to the total weight of the additive, the Quantity of organic nitrate B) is between 50 and 70% in weight of active substance with respect to the total weight of the additive, and the quantity of the dispersing agent C) is between 5 and 15% in weight of active substance, with respect to the total weight of the additive.

14. The method according to claim 13 wherein the quantity of said additive is 3.5 g/l.

15. A process for preparing a diesel fuel for diesel engines comprising: adding an additive to the diesel fuel, wherein said additive consists essentially of A) a metallic oxidation catalyst consisting of a ternary mixture of iron, cerium, and calcium, each in the form of at least one salt, B) at least one organic nitrate, and C) a dispersing agent, wherein the quantity of the oxidation catalyst A) is between 2 and 30% in weight of active substance with respect to the total weight of the additive, the quantity of organic nitrate B) is between 50 and 70% in weight of active substance with respect to the total weight of the additive, and the quantity of the dispersing agent C) is between 5 and 15% in weight of active substance, with respect to the total weight of the additive.

* * * * *